US009243373B2

(12) United States Patent
Mammoli

(10) Patent No.: US 9,243,373 B2
(45) Date of Patent: Jan. 26, 2016

(54) DRYING CYLINDER OF THE TYPE FOR PLANTS FOR THE PRODUCTION OF BITUMINOUS MACADAMS

(75) Inventor: Fabio Mammoli, Bussolengo (IT)

(73) Assignee: AMMANN ITALY S.P.A., Bussolengo (IT)

( * ) Notice: Subject to any disclaimer, the term of this patent is extended or adjusted under 35 U.S.C. 154(b) by 848 days.

(21) Appl. No.: 13/379,205

(22) PCT Filed: Jul. 5, 2010

(86) PCT No.: PCT/IB2010/053079

§ 371 (c)(1),
(2), (4) Date: Feb. 14, 2012

(87) PCT Pub. No.: WO2011/004315

PCT Pub. Date: Jan. 13, 2011

(65) Prior Publication Data

US 2012/0131812 A1 May 31, 2012

(30) Foreign Application Priority Data

Jul. 9, 2009 (EP) ..... 09425274

(51) Int. Cl.
*F26B 11/02* (2006.01)
*E01C 19/10* (2006.01)

(52) U.S. Cl.
CPC ..... *E01C 19/1036* (2013.01); *E01C 2019/109* (2013.01); *E01C 2019/1095* (2013.01)

(58) Field of Classification Search
CPC . E01C 19/1036; E01C 19/05; E01C 19/1068; E01C 2019/1095; E01C 2019/109; F26B 11/0477; F26B 11/026; F27B 7/16
USPC ..... 34/108, 135, 136, 137; 366/25, 228, 366/147, 227, 229; 432/118
See application file for complete search history.

(56) References Cited

U.S. PATENT DOCUMENTS 3,861,055 A * 1/1975 Thompson ..... 34/363
4,300,837 A 11/1981 Malbrunot
4,318,620 A 3/1982 Malipier et al.
4,354,826 A 10/1982 Kruger et al.

(Continued)

FOREIGN PATENT DOCUMENTS

DE 34 23 521 A1 1/1986
EP 0 032 468 A2 7/1981

(Continued)

*Primary Examiner* — Kenneth Rinehart
*Assistant Examiner* — Bao D Nguyen
(74) *Attorney, Agent, or Firm* — Pearne & Gordon LLP

(57) ABSTRACT

A rotary drying cylinder (1) for plants for the production of bituminous macadams, extending along a main axis (2). The drying cylinder (1) comprises a burner (7), connected to the cylinder, which generates a flame (9) that extends inside the cylinder (1). The drying cylinder (1) internally comprises a tube-shaped shielding structure (10) having an axis of extension which is substantially parallel with the main axis (2) and extending from the burner (7) so that, in practice, the flame (9) is at least mainly confined within the shielding structure (10), there thus being a separating ring (12) between the shielding structure (10) and the inner surface (13) of the drying cylinder (1). The shielding structure (10) comprises a plurality of hollows (17) facing towards the inner surface (13) of the drying cylinder (1) for containing, in practice, the material being dried. The shielding structure (10) is at least mainly made of heat conducting materials.

21 Claims, 7 Drawing Sheets

(56) References Cited

U.S. PATENT DOCUMENTS

| | | | | | |
|---|---|---|---|---|---|
| 4,422,848 | A | | 12/1983 | Musil | |
| 4,427,376 | A | | 1/1984 | Etnyre et al. | |
| 4,954,995 | A | * | 9/1990 | Marconnet | 366/7 |
| 5,305,533 | A | * | 4/1994 | Alexander et al. | 34/549 |
| 5,522,158 | A | * | 6/1996 | Swanson | 34/479 |
| 2003/0227815 | A1 | | 12/2003 | Dillman | |

FOREIGN PATENT DOCUMENTS

| | | | |
|---|---|---|---|
| EP | 0 340 462 | A1 | 11/1989 |
| WO | 98/49398 | A1 | 11/1998 |

* cited by examiner

DRYING CYLINDER OF THE TYPE FOR PLANTS FOR THE PRODUCTION OF BITUMINOUS MACADAMS

The present invention relates to a drying cylinder of the type for plants for the production of bituminous macadams.

The present invention covers all types of drying cylinders used in plants for the production of bituminous macadams. The drying cylinders, in the plant, are usually designed to dry aggregates to remove the moisture present in them and make them more suitable for mixing with liquid bitumen.

At present, prior art drying cylinders have an infeed end for the materials to be dried and an outfeed end for the dried materials. The drying cylinder usually has an axis of extension which is angled relative to the ground to promote movement of the materials to be dried from one end to the other, that is to say, from upstream to downstream.

Therefore, the upstream end is further above the ground than the downstream end, and the upstream end is the infeed end for the materials to be dried.

The materials to be dried are inserted in the cylinder through the infeed end, are heated to make the moisture present in them evaporate and then are fed out of the cylinder so that they can be mixed with bitumen. It is usually also possible to insert in the cylinder (at a predetermined section of the cylinder) recycled material obtained, for example, by cutting existing road surfaces.

Inside the cylinder, the materials to be dried are heated by a burner connected to one end of the cylinder which creates the flame inside the cylinder towards the end opposite that to which the burner is connected. The exhaust fumes produced by the burner flow along the entire cylinder towards the end opposite that to which the burner is connected, then come out of the cylinder through said end.

Depending whether or not the infeed end is the end to which the burner is connected or the other end, the cylinder is used in two different ways: in the co-current way (in which the feed direction of the fumes and the materials to be dried is the same) or counter-current (in which the feed direction of the fumes is opposite to that of the materials to be dried). In any operating mode the flame, generated by the burner during use of the drying cylinder, extends parallel with the cylinder axis of extension from the burner towards the other end of the cylinder, having a predetermined length.

Two types of heat exchange are created inside the drying cylinder during use. The first occurs in the part of the cylinder through which the fumes pass where heat is transmitted (by convection) from the fumes to the materials being dried. The second occurs in the part of the cylinder closest to the flame, where heat is transmitted from the flame towards the materials being dried (by radiation) and between the materials (by conduction).

Both types of heat exchange are usually promoted by the fact that the materials to be dried are moving, inside the drying cylinder, even in a direction substantially at a right angle to the ground, thanks to the presence inside the cylinder of blades distributed on the cylinder inner surface, which rotate together with the cylinder about the axis of extension. These blades collect the materials to be dried and convey them along the cylinder inner surface (during cylinder rotation) until gravity makes the materials to be dried come out of the blades and fall inside the cylinder.

Therefore, the materials to be dried are subjected to two main types of movement. The first is from the infeed (upstream) end towards the outfeed (downstream) end and the second is in a direction substantially at a right angle to the ground inside the drying cylinder, producing a shower effect.

The blades inside the cylinder are mainly of two types. The blades of the first type have a mouth whose width is significantly greater than the depth. Those of the second type have a mouth whose width is usually comparable (the same as or slightly less than/greater than) to the depth. The first blades are connected to the zone of the cylinder in which heat exchanges take place between the fumes and materials. In this zone, the blades shaped as described create a very intense shower effect in which most of the materials contained in the blades falls, due to gravity, inside the cylinder.

In contrast, the second type of blade is connected to the zone at the flame, where heat exchanges occur between the flame and the materials. In this zone the blades shaped as described are designed to limit the shower effect at the flame, since they can reach the highest rotation point having unloaded with showering effect even less than 20% of the material initially loaded.

This prior art technology has several disadvantages.

First, materials being dried which accidentally pass through the flame participate in the combustion which generates the flame and at the same time disturb the flame.

In particular, if the materials to be dried include cut material (containing bitumen), their exposure to the high temperatures present at the flame results in the formation of volatile compounds which, exiting the cylinder together with the exhaust fumes, may be toxic for the outside environment and for living beings who breathe them.

At the same time, the materials to be dried disturb the flame, also creating problems regarding the direction of heat propagation and in the heat exchanges with the materials to be dried, thus worsening the performance of the cylinder as a whole.

In this situation the technical purpose which forms the basis of the present invention is to provide a drying cylinder which overcomes the above-mentioned disadvantages.

In particular, the present invention has for a technical purpose to provide a drying cylinder which minimises the production of toxic substances harmful for the environment and living beings.

The present invention also has for a technical purpose to provide a drying cylinder which is more efficient in terms of heat distribution inside the cylinder and in terms of the heat exchanges with the materials being dried.

The technical purpose specified and the aims indicated are substantially achieved by a drying cylinder as described in the appended claims.

Further features and the advantages of the present invention are more apparent in the detailed description of a preferred, non-limiting embodiment of a drying cylinder illustrated in the accompanying drawings, in which.

Figure 1:
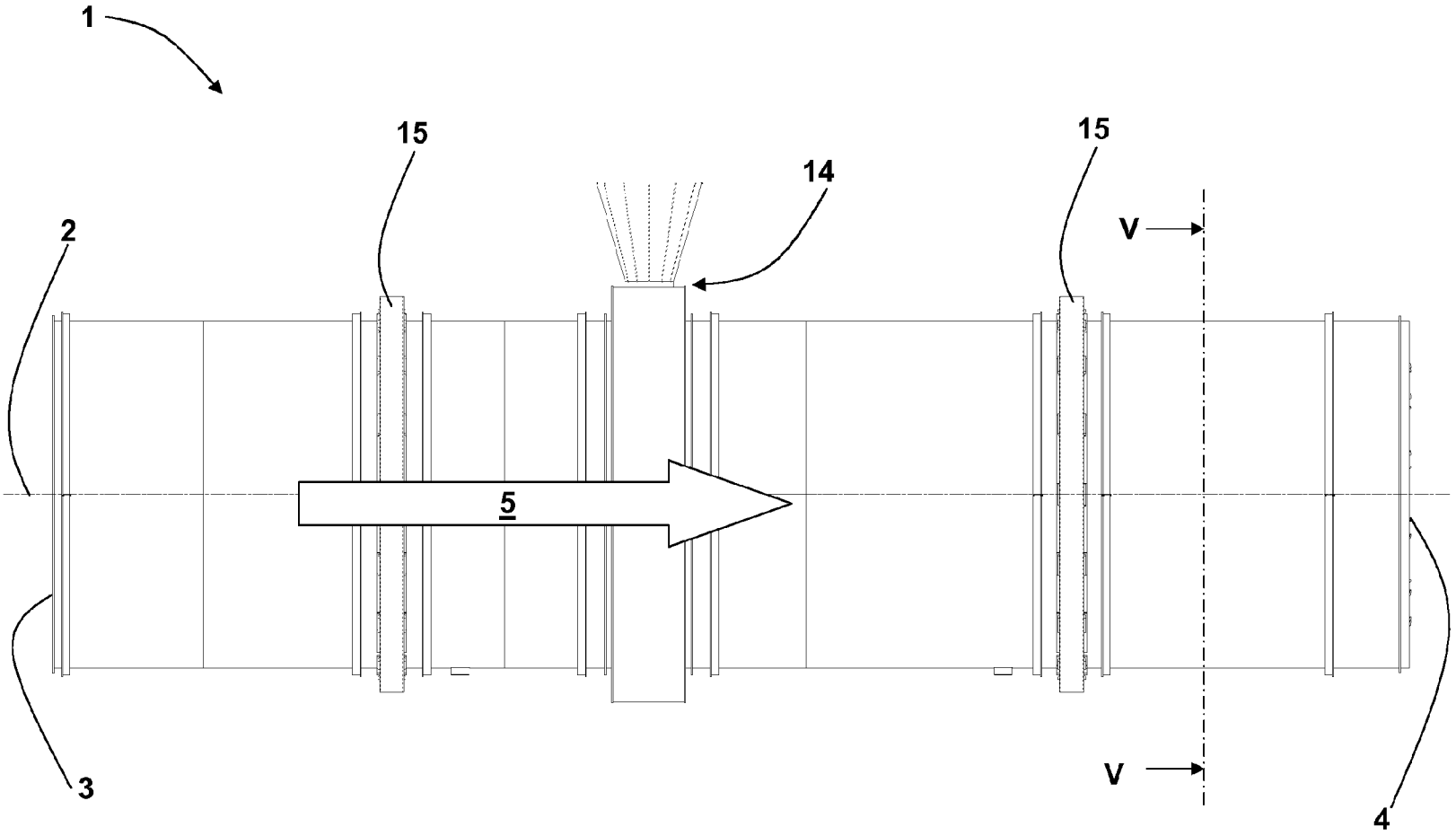
FIG. 1 is a side view of the drying cylinder made in accordance with the present invention.

With reference to the accompanying drawings the numeral 1 denotes as a whole a drying cylinder made in accordance with the present invention.

The drying cylinder 1 according to the present invention normally extends along a main axis 2 between two opposite ends: a first end 3 and a second end 4. The main axis is angled, during cylinder use, relative to the ground, thus promoting the passage of the material to be dried from one end to the other. The material to be dried enters the drying cylinder 1 from the end highest above the ground and therefore upstream relative to the material feed direction 5 in the cylinder, and comes out of the other, downstream end. The drying cylinder 1 has an inner surface 13 through which the materials being dried are in contact with the drying cylinder 1.

Figure 7:
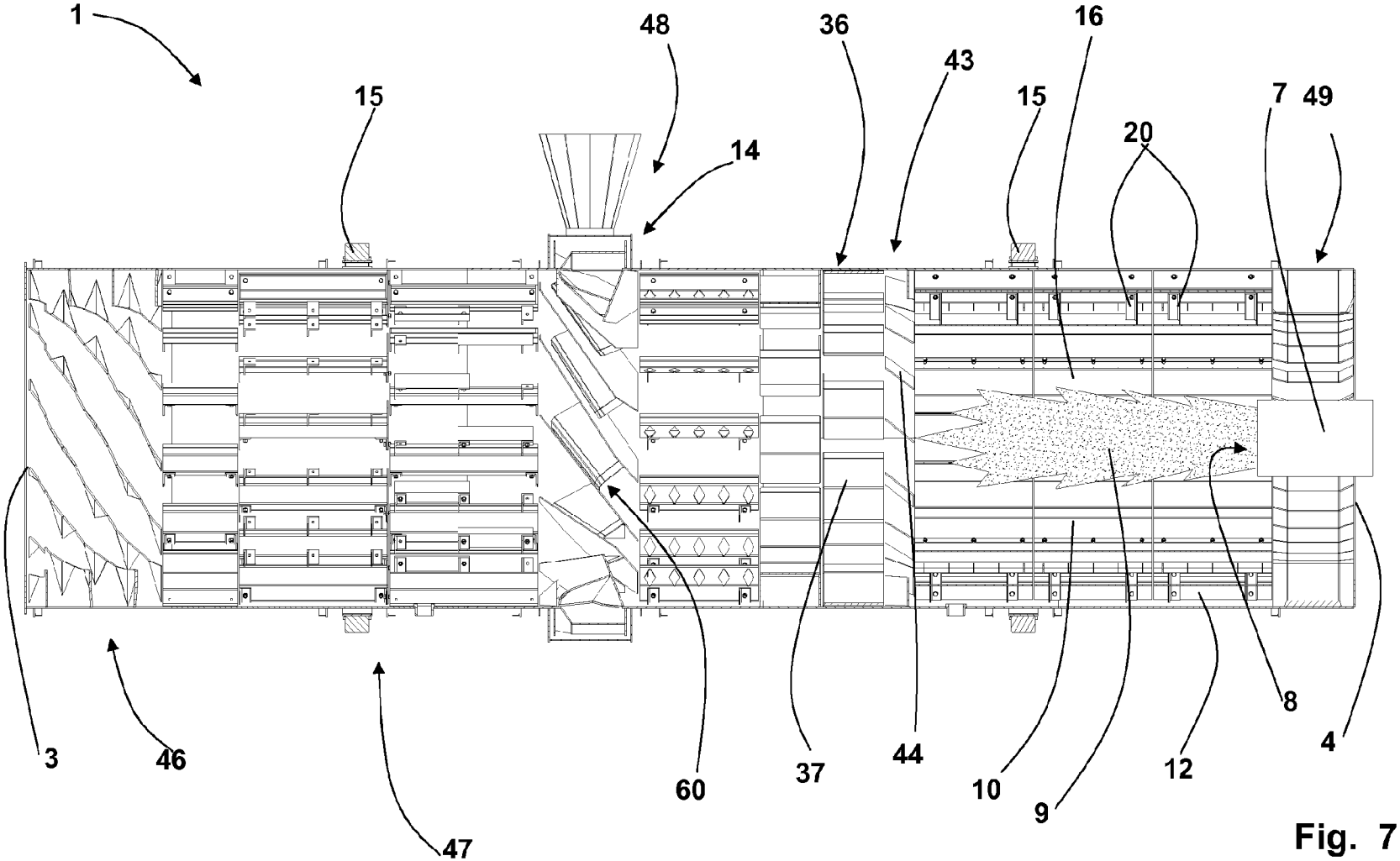
FIG. 7 shows the drying cylinder of FIG. 3 with the burner which in practice generates the flame.

The drying cylinder 1 normally comprises a burner 7, connected at the second end 4 of the drying cylinder 1, and which has a mouth 8 from which, in practice, a flame 9 comes out and extends into the cylinder towards the first end 3 (FIG. 7).

Figure 2:
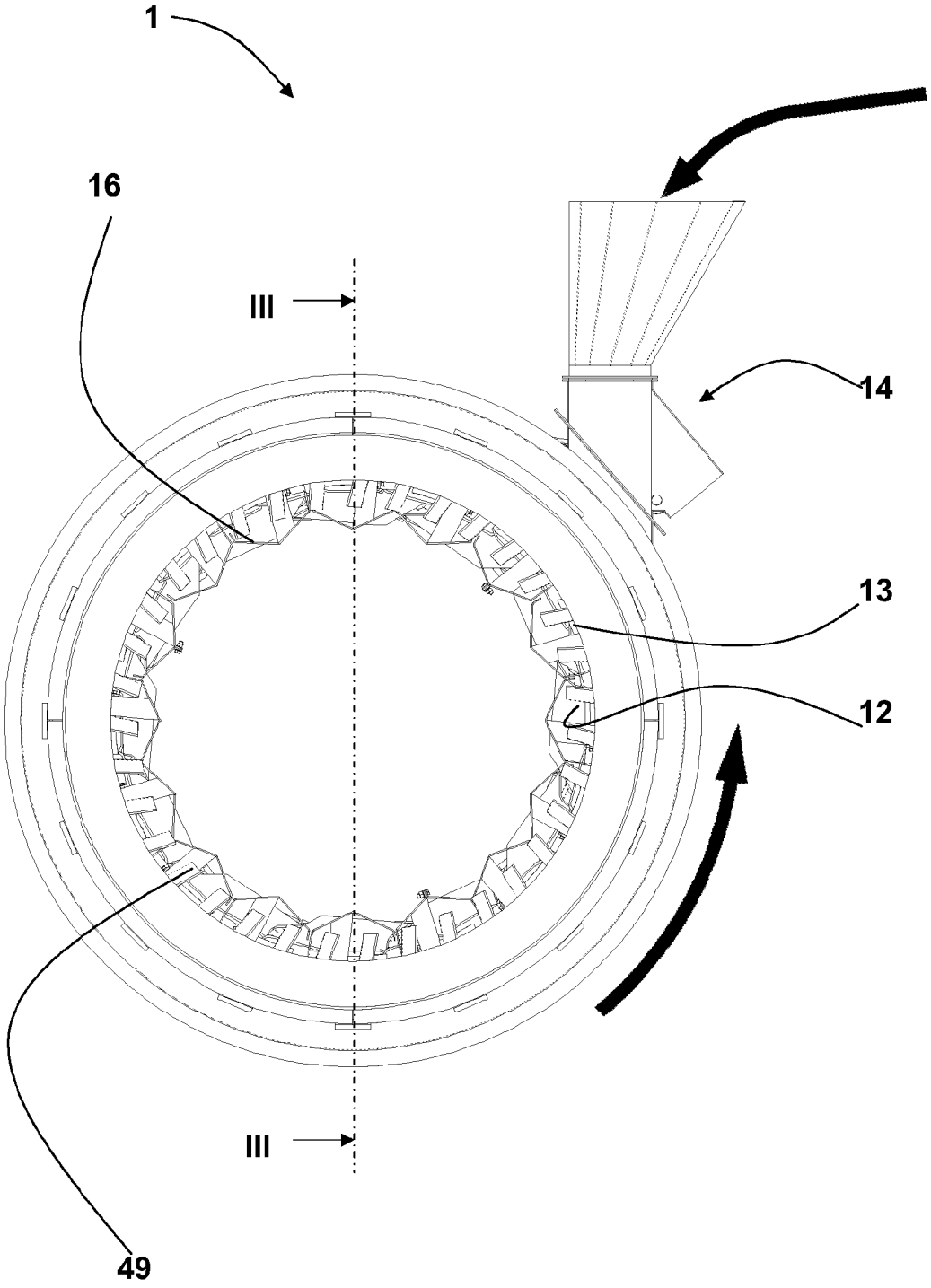
FIG. 2 is an axial front view of the drying cylinder made in accordance with the present invention seen from the right relative to FIG. 1.
Figure 3:
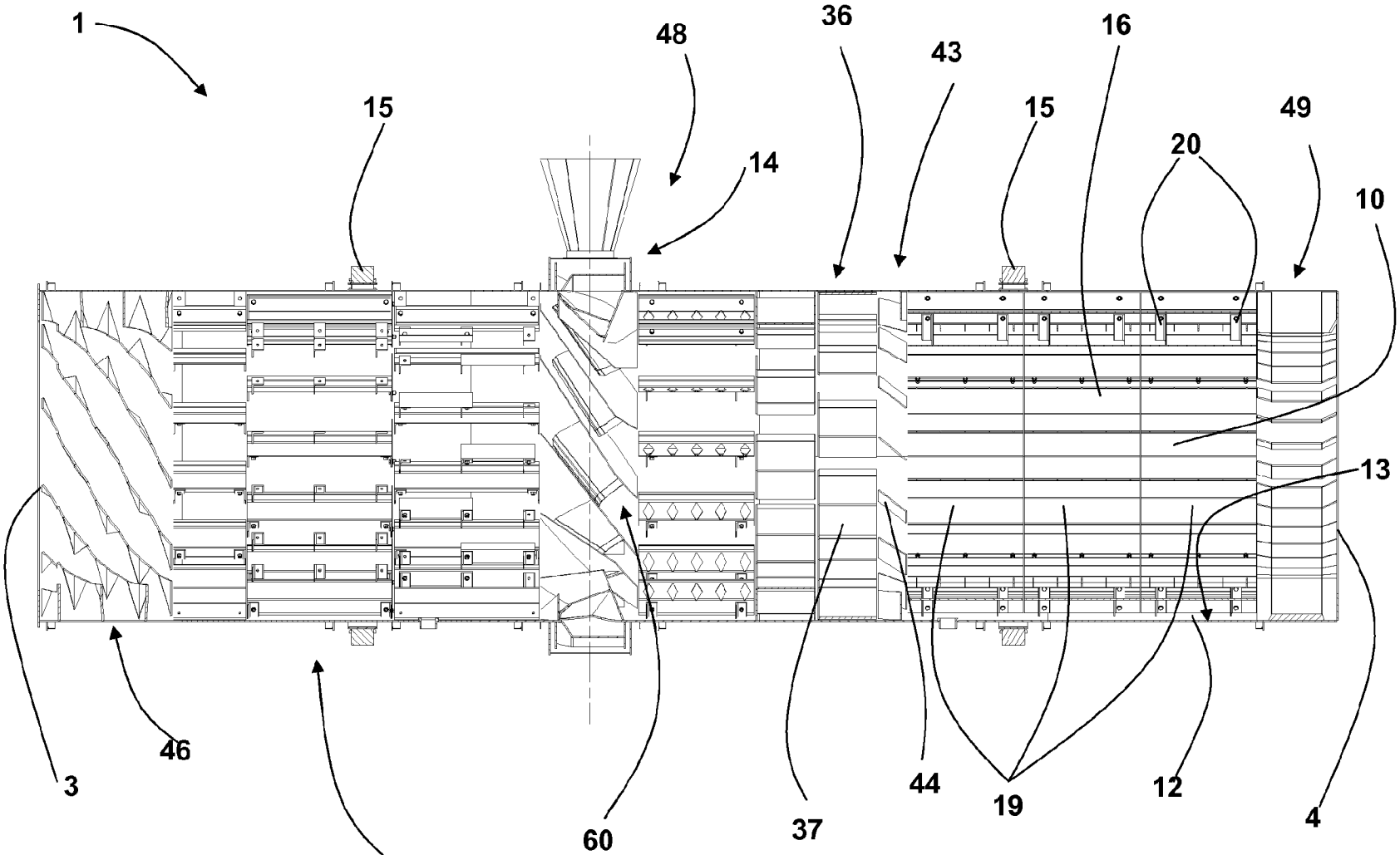
FIG. 3 is a cross-section of the drying cylinder of FIG. 2 according to the line III-III.

During use of the drying cylinder 1 the second end 4 may be positioned upstream or downstream of the first, depending on requirements. In particular, if the second end 4 is upstream, the drying cylinder 1 operates in co-current mode. In contrast, if the second end 4 is downstream, the cylinder operates in counter-current mode. The embodiment illustrated in FIG. 2 shows a drying cylinder 1 made for operating in counter-current mode, but alternatively, with suitable modifications, it may be set up for co-current operation.

According to the present invention, the drying cylinder 1 internally comprises a tube-shaped shielding structure 10, connected to the drying cylinder 1 by connecting means 11 and which has an axis of extension substantially parallel with the main axis 2. The shielding structure 10 extends from a section of the cylinder at the burner 7 towards the first end 3 and has a predetermined length so that, in practice, the flame 9 is at least mainly confined within the shielding structure 10. In this way a separating ring 12 is created between the shielding structure 10 and the inner surface 13 of the drying cylinder 1 so that a material being dried can pass in said ring (according to the preferred embodiment of the present invention all of the material being dried passes in the separating ring).

The shielding structure 10 has a plurality of hollows 17 facing towards the inner surface 13 of the drying cylinder 1 for containing, in practice, the material being dried as it passes through the cylinder. The shielding structure 10 is made of heat-conducting materials which promote the passage of heat towards the separating ring 12. The structure is therefore designed to transmit heat towards the separating ring 12 and to shield the flame 9 from the material being dried which is in transit in the separating ring 12, preventing the material from making contact with the flame 9 (as described in more detail below).

FIG. 1 shows a drying cylinder 1 in which the materials to be dried enter the left-hand side of the cylinder and come out of the right-hand side.

Half way along the cylinder there is another infeed 14 for the cut material or other recycled material.

FIG. 1 also shows supporting rings 15 for making the drying cylinder 1 rotate about its main axis of extension 2.

Figure 5:
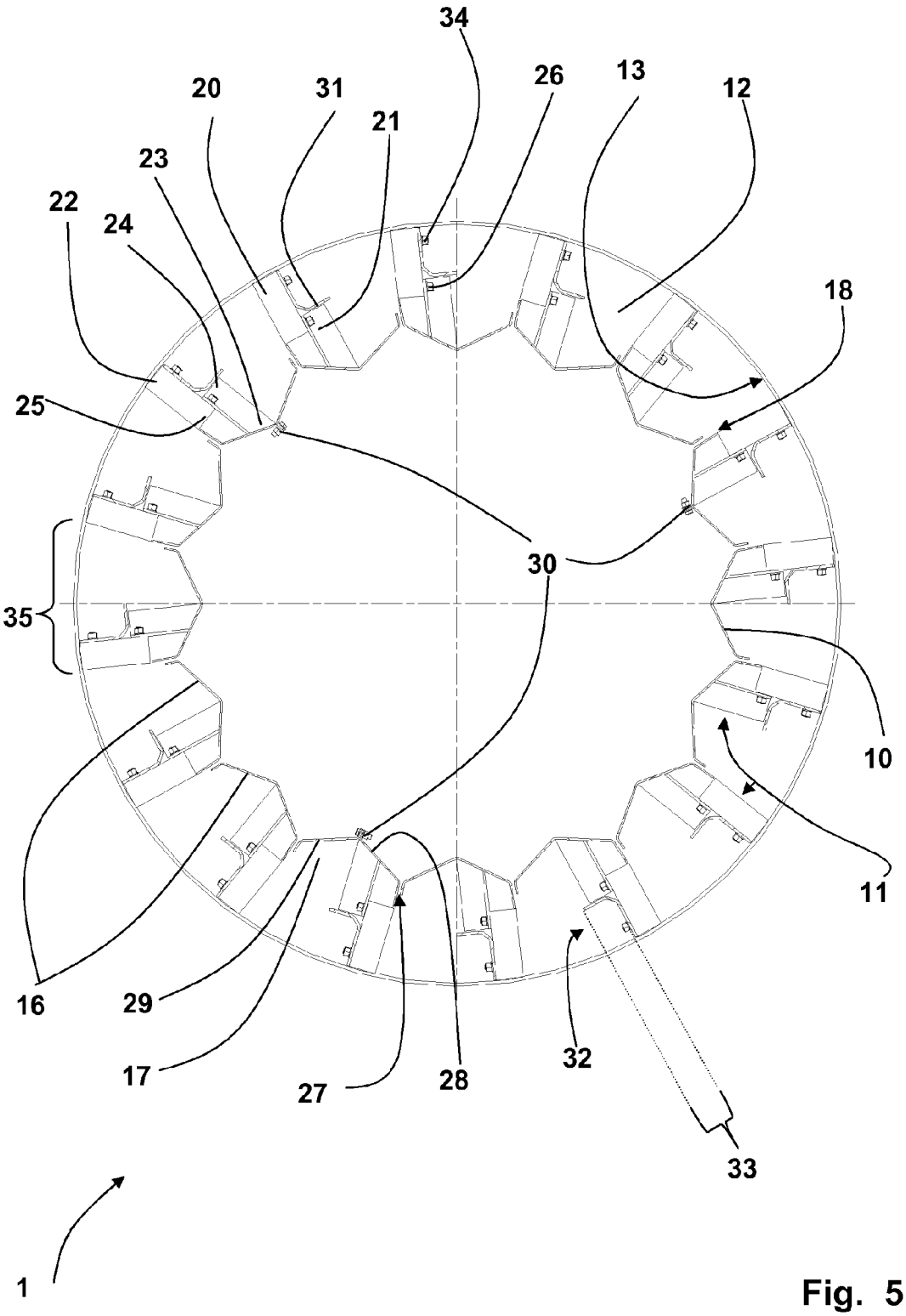
FIG. 5 is a cross-section of the drying cylinder of FIG. 1 according to the line V-V, with background parts cut away for clarity.

In the preferred embodiment illustrated in FIG. 5 the shielding structure 10 comprises a plurality of bent tile-shaped elements 16 each having a concave part forming one of the hollows 17 delimited by two lateral edges 18 and a linear extension substantially parallel with the main axis 2 of the drying cylinder 1. These bent tile-shaped elements 16 are positioned side by side so that the lateral edge 18 of one is adjacent to the lateral edge 18 of another element and so that together the bent tile-shaped elements 16 form the shielding structure 10.

Figure 4:
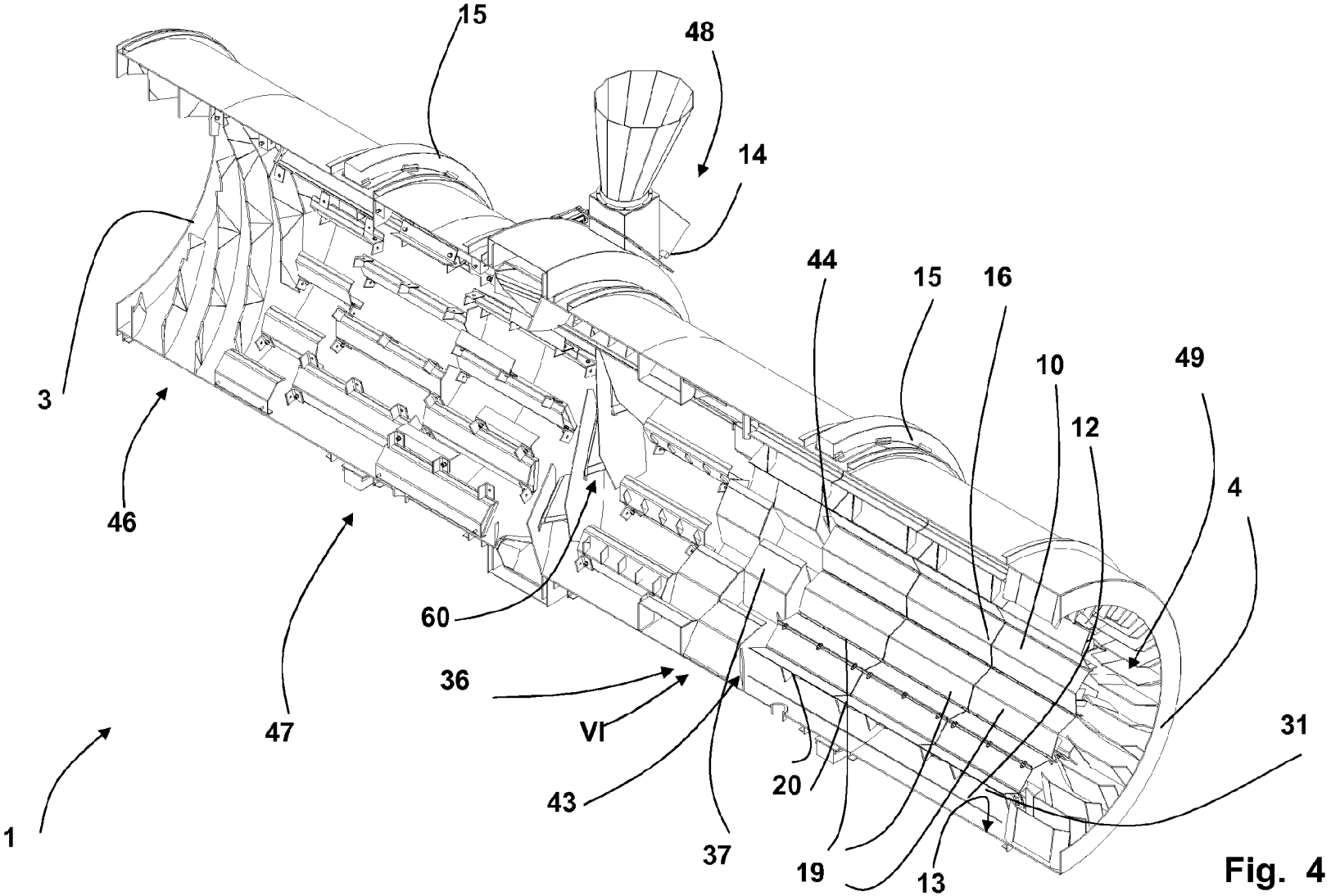
FIG. 4 is an axonometric cross-section of the drying cylinder of FIG. 2 according to the line III-III.

Each bent tile-shaped element 16 may comprise a single piece extending over the entire length of the shielding structure 10, or preferably (as illustrated in FIG. 4) a plurality of pieces 19 drawn near and following on from each other so that the linear extension of each is parallel with the main axis 2. In the preferred embodiment illustrated in FIG. 4 each bent tile-shaped element 16 comprises three identical pieces 19, each fastened (by connecting means 11) at two points to the inner surface 13 of the drying cylinder 1. The connecting means 11 advantageously comprise at least two L-shaped brackets 20 and 21 for each fastening point, each having two ends.

Each of the two brackets 20 and 21 has a first end 22 and 23 respectively welded on the inner surface 13 of the drying cylinder 1 and to the bent tileshaped element 16, whilst the second ends 24 and 25 of the two brackets 20 and 21 are superposed so that they can be fastened to each other using first bolts 26 (FIG. 5).

In FIG. 5 the edges 18 of the bent tile-shaped elements 16 are facing towards the inner surface 13 of the cylinder and are adjacent to each other, thus forming the tubular shielding structure 10 which contains the flame 9 during use of the drying cylinder 1. Therefore, as already indicated, this structure prevents the materials being dried from interfering with the flame 9, confining them within the separating ring 12. In the embodiment illustrated in FIG. 5 between two adjacent edges 18 of the bent tile-shaped elements 16 there is a free space 27. This allows for expansion of the bent tile-shaped elements 16 due to the heat generated by the flame 9 during use, as well as facilitating evacuation from the separating ring 12 of any vapours or other volatile compounds which may be formed. The free space 27 is sized so that, in practice, the material being dried does not pass through it from the separating ring 12 towards the flame 9 and make contact with the flame.

Advantageously, some bent tile-shaped elements 16 may each comprise two separate parts, a first fixed part 28 fastened to the inner surface 13 of the drying cylinder 1, and a mobile second part 29 fastened to the first part by removable connecting means 30. This particular configuration is useful during drying cylinder 1 assembly and during substitution of parts inside the separating ring 12. Since there are two separate parts, it is possible, by removing the mobile second part 29, to gain access to the separating ring 12. Only in this way can the shielding structure 10 be fully assembled or any damaged parts substituted. In FIG. 5 three of the bent tile-shaped elements 16 have this division between a fixed first part 28 welded to one of the brackets 21 and a mobile parts 29. The bent tile-shaped element 16 is preferably divided into the two parts at a line parallel with the main axis of extension 2 and which divides the bent tile-shaped element 16 into two symmetrical parts. The removable connecting means 30 which hold together the two parts of each bent tile-shaped element 16 are advantageously second bolts.

The bent tile-shaped elements 16 are made of heat conducting materials, preferably carbon steel and/or stainless steel which are resistant to high temperatures.

Inside the separating ring 12 there is a plurality of container blades 31 mounted on the inner surface 13 of the drying cylinder 1. These container blades 31 are distributed radially along the inner surface 13 of the drying cylinder 1 at least at the shielding structure 10 and have an infeed mouth 32 and a loading depth 33. Advantageously, the infeed mouth 32 may have a width, in the radial direction relative to the main axis 2, which is significantly greater than the depth 33 of the blades. This simplifies the structure of the blades which are more open than those normally used in drying cylinders at the flame 9, so that the materials being dried contained in the blades, due to drying cylinder rotation, fall as soon as possible on the shielding structure 10 into the hollows 17 formed by the bent tile-shaped elements 16. In this way, the elements being dried remain on the shielding structure 10 for a long time, absorbing heat for as long as possible.

The container blades 31 are fastened to the inner surface 13 of the drying cylinder 1 and may be positioned parallel with the main axis 2 and distributed radially relative to the main axis 2 (FIG. 4). In an alternative embodiment, not illustrated, the container blades 31 may be fastened to the inner surface 13 in such a way that they are at an angle to the main axis 2. In addition, the container blades 31 may comprise a single piece, extending over the entire length of the shielding structure 10, or only part of it, or preferably comprise two or more pieces following on from each other positioned along the same line of extension. In the preferred embodiment illustrated in FIG. 4, each blade 31 comprises two or more pieces following on from each other and parallel with the main axis 2 of extension of the drying cylinder 1. In the embodiment illustrated in FIG. 5 each container blade 31 is fastened to the inner surface 13 of the drying cylinder 1 at each bent tile-shaped element 16. Advantageously, as illustrated in FIG. 5, each container blade 31 is fastened to the inner surface 13 of the drying cylinder 1 by means of the brackets 20 and 21 welded to the inner surface 13 of the drying cylinder 1. Advantageously, each container blade 31 is fastened to the brackets 20 by means of third bolts 34. Observing FIG. 5, it can be seen how the shielding structure 10 and the separating ring 12 are substantially radially divided into sectors 35, each sector 35 comprising a bent tile-shaped element 16, a container blade 31 and the corresponding brackets 20 and 21.

Figure 6:
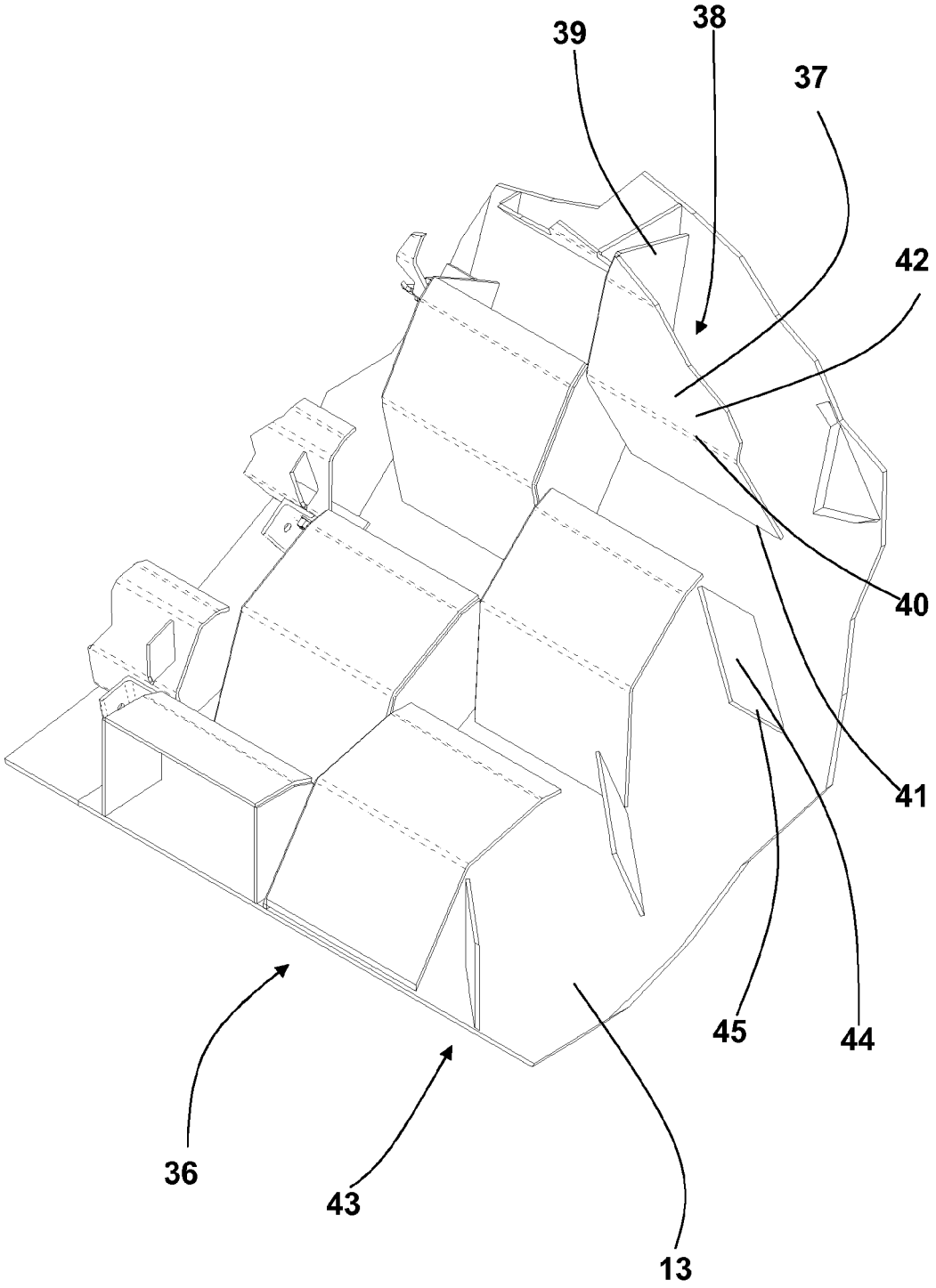
FIG. 6 is an axonometric view of an enlarged detail of the drying cylinder of FIG. 4 indicated by the arrow VI.

Between the first end 3 and the separating ring 12, and close to the latter, advantageously there is a blade assembly 36 comprising a set of insertion blades 37 connected to the inner surface 13 of the drying cylinder 1 for inserting the materials being dried into the separating ring 12 (FIG. 6).

Each of the insertion blades 37 forms an inner containment chamber 38 closed at the side 39 facing towards the first end 3 and open at the side facing towards the second end 4, thus in practice facilitating insertion of the materials being dried into the separating ring 12.

In the embodiment illustrated each insertion blade 37 mainly comprises two parts: a first, containment part 40 with a portion 41 fastened to the inner surface 13 and a portion 42 projecting from it, together with the cylinder inner surface forming the inner containment chamber 38 of the insertion blade 37, and a second, lateral part 39 connecting the projecting portion 42 of the insertion blade 37 to the inner surface 13, thus closing the insertion blade 37 at the side 39 of the insertion blade 37 facing towards the first end 3.

Between the blade assembly 36 and the separating ring 12 there are also preferably pushing means 43 for conveying the material being dried from the blade assembly 36 towards the separating ring 12.

These pushing means 43 comprise a plurality of panels 44 having a main surface of extension 45, which are connected to the inner surface 13 of the drying cylinder 1 and distributed circumferentially along the inner surface 13 of the drying cylinder 1. Each panel 44 preferably extends according to a trajectory with spiral extension relative to the main axis 2 and is positioned in such a way that it is angled towards the separating ring 12 during the cylinder 1 rotation step in which the panel 44 moves upwards, thus facilitating the passage of material into the separating ring 12. In the preferred embodiment illustrated in FIG. 6, each panel is connected to the inner surface 13 of the drying cylinder 1 and has its main surface of extension 45 substantially at a right angle to the inner surface 13.

The rest of the drying cylinder 1 according to the present invention has many features like those of the prior art. FIG. 4 shows how at the first end 3 there is an infeed fin assembly 46 for promoting the infeed of material into the cylinder thanks to cylinder rotation.

Downstream of said fin assembly there are infeed blades 47 of various types which promote remixing of the material inside the drying cylinder 1 and create the above-mentioned shower effect.

Downstream of the infeed blades 47 and upstream of the blade assembly 36 (described above) there is a mixing zone 48 for the aggregates and cut material, designed to mix the hot aggregates with the cut material. The latter enters the drying cylinder 1 through openings (not illustrated) which are radial relative to the main axis 2 of the cylinder, made in the inner surface 13 of the cylinder at the mixing zone 48. Each opening is made by means of a specific insertion channel 60. At the second end 4 there are outfeed blades 49 which convey the dried material to the outside of the cylinder where it will be mixed with bitumen.

Drying cylinder 1 use derives immediately from what is described above. In particular, the cylinder is made to rotate along the main axis of extension 2 and the materials to be dried enter the cylinder, aided by the infeed fin assembly 46, through the first end 3 in the case of counter-current operation (case illustrated) or from the second end 4 in the case of co-current operation; the materials are moved towards the outfeed end thanks to the combined effect of angling, rotation and the blades. In particular, the materials being dried flow along the drying cylinder 1 passing through the zone 48 for mixing with the cut material, then enter the blade assembly 36 which facilitates infeed into the separating ring 12. The insertion blades 37 of which the blade assembly 36 is composed facilitate material infeed into the separating ring 12 thanks to their open side, facing towards the second end 4. The materials then come out of the blades 37 (towards the second end 4) and, thanks to the presence of the panels 44, are pushed into the separating ring 12.

Inside the separating ring 12 the materials being dried are loaded into the container blades 31 which rotate with the drying cylinder 1. At a predetermined point, container blade 31 rotation relative to the main axis 2 and gravity push the materials being dried out of the container blades 31, making them fall onto the bent tile-shaped elements 16 which collect them in the hollows 17.

In this way, the materials flow, for a predetermined period of time depending on the speed of rotation, on the bent tile-shaped elements 16, in direct contact with them and directly receiving the heat transmitted by the flame 9 through the bent tile-shaped elements 16. The materials then fall inside the separating ring 12 and are again collected by the container blades 31 which are loaded with the materials so that they can release them onto the bent tile-shaped elements 16. This process is repeated until the materials reach the second end 4 where they are fed out of the drying cylinder 1 with the aid of the outfeed blades 49.

The present invention brings important advantages.

First, the shielding structure prevents the materials being dried from making contact with the flame and generating gases which are harmful for the environment and living beings. The materials being dried pass through the separating ring, avoiding any contact with the flame.

Second, the shielding structure made of heat conducting materials promotes conduction of the heat from the flame to the materials being dried, guaranteeing high temperatures inside the separating ring.

In particular, the shielding structure hollows together with the container blades guarantee contact between the materials being dried and the shielding structure, improving heat transmission and therefore drier performance: thanks to this, it is possible to build a drying cylinder which is shorter than prior art cylinders, guaranteeing the same amount of heat transmitted to the materials being dried, and therefore the same productivity.

Or, the length of the drying cylinder being equal to that of prior art cylinders, the drying cylinder according to the present invention allows an increase in productivity, allowing operation at higher speeds thanks to the improved efficiency of the drying cylinder in terms of heat transmission.

It should also be noticed that the present invention is relatively easy to produce and that even the cost linked to implementing the invention is not very high.

The invention described above may be modified and adapted in several ways without thereby departing from the scope of the inventive concept.

Moreover, all details of the invention may be substituted with other technical equivalent elements and in practice all of the materials used, as well as the shapes and dimensions of the various components, may vary according to requirements.

The invention claimed is:

1. A rotary drying cylinder (1) for plants for the production of bituminous macadams, the cylinder extending, between a first end (3) and a second end (4) opposite the first, along a main axis (2) which is set at an angle to the ground, and having an inner surface (13); the drying cylinder (1) comprises a burner (7), connected to the cylinder at the second end (4), and generating a flame (9) which extends inside the cylinder towards the first end (3) and a plurality of container blades (31) mounted on the inner surface (13) of the cylinder; the cylinder being characterised in that it internally comprises a tube-shaped shielding structure (10), connected to the drying cylinder (1), having an axis of extension parallel with the main axis (2) and extending from the burner (7) towards the first end (3) for a predetermined length so that, in practice, the flame (9) is at least mainly confined within the shielding structure (10) in a flame zone, the cylinder also being characterised in that it comprises a separating ring (12) between the shielding structure (10) and the inner surface (13) of the drying cylinder (1) so that a material being dried can pass in the separating ring (12), the cylinder also being characterised in that the container blades (31) are inside the separating ring (12) and are mounted on the inner surface (13) of the cylinder at least at the separating ring (12); the shielding structure (10) comprising a plurality of hollows (17) facing towards the inner surface (13) of the drying cylinder (1) for containing, in practice, the material being dried, the shielding structure (10) being at least mainly made of heat-conducting materials and confining the material being dried in the separating ring so shielding the flame (9) from the material being dried which is in transit in the separating ring (12) and preventing the material from making contact with the flame (9), the shielding structure (10) being configured such that the material does not pass through the shielding structure (10) into the flame zone during rotation of the cylinder, characterised in that between the first end (3) and the separating ring (12) and close to the latter there is a blade assembly (36) comprising a set of insertion blades (37) connected to the inner surface (13) of the drying cylinder (1) for inserting the materials being dried in the separating ring (12); each of the insertion blades (37) forming an inner containment chamber (38), and characterized in that the containment chamber (38) of each insertion blade (37) is closed at the side (39) facing towards the first end (3) and open at the side facing towards the second end (4), thus in practice facilitating insertion of the materials being dried into the separating ring (12).

2. The drying cylinder (1) according to claim 1, characterised in that the shielding structure (10) comprises a plurality of bent tile-shaped elements (16) each having a concave part (17) delimited by two lateral edges (18); the bent tile-shaped elements (16) being positioned side by side so that the lateral edge (18) of one is adjacent to the lateral edge (18) of another element and so that together the bent tile-shaped elements (16) form the shielding structure (10).

3. The drying cylinder (1) according to claim 2, further comprising means (11) for connecting the shielding structure (10) to the inner surface (13) of the drying cylinder (1), the means for connecting comprising at least one bracket for each bent tile-shaped element (16).

4. The drying cylinder (1) according to claim 3, characterised in that the shielding structure (10) is made of carbon steel and/or stainless steel.

5. The drying cylinder (1) according to claim 3, characterised in that the container blades (31) are distributed radially along the inner surface (13) of the drying cylinder (1) at least at the shielding structure (10) and comprise an infeed mouth (32) and a loading depth (33), the infeed mouth (32) having a width in the direction radial relative to the main axis (2) which is greater than the depth of the blades.

6. The drying cylinder (1) according to claim 5, wherein each of the container blades (31) is positioned parallel with the main axis (2) or set at an angle to it and comprises a single piece extending over the entire length of the shielding structure (10) or only part of it, or comprises two or more pieces following on from each other arranged along the same line of extension.

7. The drying cylinder (1) according to claim 3, characterised in that between the first end (3) and the separating ring (12) and close to the latter there is a blade assembly (36) comprising a set of insertion blades (37) connected to the inner surface (13) of the drying cylinder (1) for inserting the materials being dried in the separating ring (12); each of the insertion blades (37) forming an inner containment chamber (38).

8. The drying cylinder (1) according to claim 2, characterised in that the shielding structure (10) is made of carbon steel and/or stainless steel.

9. The drying cylinder (1) according to claim 2, characterised in that the container blades (31) are distributed radially along the inner surface (13) of the drying cylinder (1) at least at the shielding structure (10) and comprise an infeed mouth (32) and a loading depth (33), the infeed mouth (32) having a width in the direction radial relative to the main axis (2) which is greater than the depth of the blades.

10. The drying cylinder (1) according to claim 9, wherein each of the container blades (31) is positioned parallel with the main axis (2) or set at an angle to it and comprises a single piece extending over the entire length of the shielding structure (10) or only part of it, or comprises two or more pieces following on from each other arranged along the same line of extension.

11. The drying cylinder (1) according to claim 2, characterised in that between the first end (3) and the separating ring (12) and close to the latter there is a blade assembly (36) comprising a set of insertion blades (37) connected to the inner surface (13) of the drying cylinder (1) for inserting the materials being dried in the separating ring (12); each of the insertion blades (37) forming an inner containment chamber (38).

12. The drying cylinder (1) according to claim 2, wherein there is a free space (27) between said adjacent lateral edges (18).

13. The drying cylinder (1) according to claim 12, wherein said free space (27) allows for expansion of the bent tile-shaped elements (16) due to heat generated by the flame (9) during use.

14. The drying cylinder (1) according to claim 12, wherein said free space (27) facilitates evacuation from the separating ring (12) of vapors.

15. The drying cylinder (1) according to claim 12, wherein the free space (27) is sized so that, in practice, the material does not pass through the free space (27) from the separating ring (12) towards the flame (9) and make contact with the flame (9).

16. The drying cylinder (1) according to claim 1, characterised in that the shielding structure (10) is made of carbon steel and/or stainless steel.

17. The drying cylinder (1) according to claim 1, characterised in that the container blades (31) are distributed radially along the inner surface (13) of the drying cylinder (1) at least at the shielding structure (10) and comprise an infeed mouth (32) and a loading depth (33), the infeed mouth (32) having a width in the direction radial relative to the main axis (2) which is greater than the depth of the blades.

18. The drying cylinder (1) according to claim 17, wherein each of the container blades (31) is positioned parallel with the main axis (2) or set at an angle to it and comprises a single piece extending over the entire length of the shielding structure (10) or only part of it, or comprises two or more pieces following on from each other arranged along the same line of extension.

19. The drying cylinder (1) according to claim 1, wherein between the blade assembly (36) and the separating ring (12) there are also pushing means (43) for conveying the material being dried from the blade assembly (36) towards the separating ring (12).

20. The drying cylinder (1) according to claim 19, characterised in that the pushing means (43) comprise a plurality of panels (44) having a main surface of extension (45), the panels being connected to the inner surface (13) of the drying cylinder (1) and positioned along the inner surface (13) of the drying cylinder (1); each panel being angled towards the separating ring (12), thus facilitating the passage of material into the separating ring (12).

21. The drying cylinder (1) according to claim 20, characterised in that each panel is angled towards the separating ring (12) according to a trajectory with spiral extension relative to the main axis (2).

* * * * *